United States Patent [19]

Chibnik

[11] Patent Number: 4,675,027

[45] Date of Patent: Jun. 23, 1987

[54] FUEL COMPOSITIONS HAVING IMPROVED LOW TEMPERATURE CHARACTERISTICS

[75] Inventor: Sheldon Chibnik, Cherry Hill, N.J.

[73] Assignee: Mobil Oil Corporation, New York, N.Y.

[21] Appl. No.: 726,569

[22] Filed: Apr. 24, 1985

[51] Int. Cl.[4] ..... C10L 1/18

[52] U.S. Cl. ..... 44/57; 44/68

[58] Field of Search ..... 44/57, 68; 260/414

[56] References Cited

U.S. PATENT DOCUMENTS

| | | | |
|---|---|---|---|
| 3,962,104 | 6/1976 | Swietlik et al. | 257/32.7 E |
| 4,029,682 | 6/1977 | Foulks, Jr. | 260/414 |
| 4,283,314 | 8/1981 | Zeilstra et al. | 260/23 AR |
| 4,294,771 | 10/1981 | Pietralla et al. | 260/414 |
| 4,337,208 | 6/1982 | Petronella | 260/414 |
| 4,438,038 | 3/1984 | Petronella | 260/414 |
| 4,505,718 | 3/1985 | Dorer, Jr. | 44/68 |

FOREIGN PATENT DOCUMENTS 0010807 10/1979 European Pat. Off. .

*Primary Examiner*—Mrs. Y. Harris-Smith

*Attorney, Agent, or Firm*—Alexander J. McKillop; Michael G. Gilman; Howard M. Flournoy

[57] ABSTRACT

Heavy metal salts of certain branched chain carboxylic acids significantly improve the filterability, pour point and cloud point of liquid hydrocarbyl fuels when incorporated therein.

29 Claims, No Drawings

FUEL COMPOSITIONS HAVING IMPROVED LOW TEMPERATURE CHARACTERISTICS

CROSS REFERENCE TO RELATED APPLICATIONS

This application relates to copending applications Ser. Nos. 604,189; 604,295; 604,294 and 604,293, all filed on Apr. 26, 1984 and relating to low temperature characteristics of liquid hydrocarbon fuels.

BACKGROUND OF THE INVENTION

This invention relates to fuel compositions having improved low temperature characteristics. More particularly this invention relates to compositions comprising distillate hydrocarbon fuels having minor amounts of heavy metal salts of certain branched chain carboxylic acids.

As is well known to those skilled in the art, diesel fuels present problems at low temperatures because of poor flow characteristics and clogging of fuel filters. Consequently there is a continuing need for more efficient means for solving these low temperature problems. The materials described herein are metal salts of specific monocarboxylic acids which when added to a diesel fuel significantly improve its filterability, cloud point and pour point.

European Patent Application No. 79200612.4, (Publication No. 010 807 Al) filed on Oct. 25, 1979, discloses derivatives of branched chain monocarboxylic acids. These are amides of ammonia and aliphatic or aromatic amines having at least 1 to 15 primary or secondary amino groups, or salts of alkali metals or alkaline earth metals. The anion of these derivatives is a branched chain monocarboxylic acid moiety commonly known as a telomer acid.

U.S. Pat. No. 4,283,314 discloses resin compositions having improved lubricating properties which employ branched chain high molecular weight ester derivatives of monocarboxylic acids. These monocarboxylic acids can be of the telomer acid type.

The telomer acids described in the aforementioned European Patent Application Publication No. 0 010 807 Al (AKZO CHEMIE) are commercially available through Akona, Inc., Asheville, N.C. European Patent Application Publication No. 0 010 807 Al and U.S. Pat. No. 4,283,314 are incorporated herein in their entirety by reference.

Additives effective in lubricating oils are not necessarily effective in distillate fuels. See Table 1, Example 1, a commercial telomer acid calcium salt (average side chain length or acid about $C_{14}$) made by Akzo Chemie shows no effect on any of the properties.

It is known that additives which affect pour point cannot be presumed to affect other low temperature properties such as cloud point or filterability, see commercial additive data (Example 3) of Table 1.

The characteristics of telomer acids and their derivatives have been widely explored by Akzo Chemie. Outstanding properties in the areas of clarity, lubricity, rheology, thermo-oxidative and UV stability have been found. The chemical and physical properties of telomer acids and their derivatives suggest advantages for their application in diverse areas such as polymer additives, metal lubricant additives, spin finishes, metal ion extraction complexing aids, printing inks, surface active formulations, coatings, hot melts, greases, specialty plasticisers and water repellants. But there is no prior art known to applicant which discloses or suggests that telomer acid derivatives would be useful in distillate diesel fuels.

One object of this invention is to provide an additive product which will operate to lower the cloud point and the pour point of hydrocarbon fuels and improve their fillterability.

A further object of the invention is to provide a process for preparing an additive product comprising a heavy metal salt of a branched chain carboxylic acid wherein metallic contaminants such as calcium and sodium are avoided, by reacting the heavy metal oxide and the carboxylic acid, in the presence of a water/immiscible organic solvent system, with a heavy metal sulfate.

SUMMARY OF THE INVENTION

Applicant has now discovered that the reaction product obtained by heating equivalent amounts of a heavy metal salt and a telomer acid under appropriate reaction conditions results in an additive product which improves the filterability and reduces the pour point and cloud point of hydrocarbon fuels. Other aspects of the invention will become apparent in the following disclosure.

DESCRIPTION OF THE INVENTION

The invention is directed to a method of improving the low temperature characteristics such as filterability, cloud point and pour point of distillate diesel fuels comprising adding a minor effective amount of a heavy metal salt of a branched chain carboxylic acid to said diesel fuel. Fuel compositions containing said metal salts comprise a major proportion of a liquid hydrocarbon fuel and a minor proportion of a heavy metal salt of a branched chain carboxylic acid wherein said acid is a telomer acid and to a method of making same.

Suitable distillates generally have an initial boiling point of about 350° F. and an end point of about 675° F. Suitable branched chain carboxylic acids are preferably telomer acids.

A telomer acid in accordance with the present invention is one which ordinarily has a branched chain structure of which at least 10 percent by weight conforms to the following generalized formula

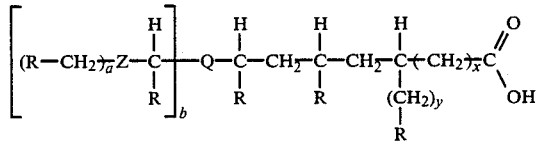

wherein
a is 0 or 1, and
if a is 0, Z is H, and
if a is 1, Z is a $CH_2$—group;
wherein
b is 0 or 1, and
if b is 0, Q is H and
if b is 1, Q is a $CH_2$—group, and
wherein
x is 0 or 2, and
if x is 0, y is 2 and
if x is 2, y is 0; and
R is $CH_3(CH_2)_n$, where n is an integer of from about 3 to about 42.

Preferred telomer acids are those made from $C_{10}$–$C_{20}$ olefins and are available commercially under the tradename Kortacid T-1801 through AKZONA, Inc. Asheville, N.C.

The telomer acids described herein may be prepared by the free radical addition of one mole of acetic anhydride to at least 3 moles of hexene and/or higher olefin having up to 30 or more carbon atoms ($C_{30}$+) in the presence of a trivalent manganese compound or in any other convenient manner known in the art. The metal salts may be prepared in accordance with U.S. Pat. No. 4,283,314 or in any convenient manner known to the art. Usually equivalent amounts of metal and telomer acid are reacted. The equivalent amounts will vary with the particular heavy metal used. Reaction temperatures can vary from ambient, about 70° F., to about 300° F. Reaction times can average from about one to about 16 hours or longer.

Because of varying legal requirements for fuels around the world and adverse affects on performance in the presence of certain metals, the preparation of salts such as manganese (II) and iron (II) described herein below utilizes a method not contemplated in the Akzo patent. By reaction of an intermediate (not isolated) calcium salt in a two-phase water/immiscible organic solvent system with a sulfate of a heavy metal, all calcium is removed and the presence of sodium (a gum promoter) is avoided in the final additive product. The telomer acids in accordance with the invention generally have side chains of from about 8 to about 18 carbon atoms, i.e., they are prepared from olefins having about 10 to about 20 carbon atoms. Preferred are telomer acids having side chains of from about 12 to 16 carbon atoms.

Any suitable heavy metal may be utilized herein. By heavy metal is meant any appropriate metal having a greater atomic weight than sodium. Preferred metals include but are not limited to Mg, Mn, Fe and Co. Generally speaking, a metal oxide, metal salt or metal hydroxide is reacted in at least equivalent amounts with the telomer acid and the intermediate product thereof is reacted in at least equivalent amounts with, for example, a metal sulfate.

Any suitable organic solvent may be used including toluene, benzene, xylene, various alcohols, ketones and esters. Toluene is preferred.

The additives may be used effectively in the disclosed diesel fuels in an amount ranging from about 0.01 wt. % to about 5 wt. % based on the total weight of the fuel composition. In certain cases depending, inter alia, on the particular fuel and/or weather conditions, up to about 10 wt. % may be used.

EXAMPLE 9

The preparation of an Iron (II) Salt in accordance with the invention is as follows: A mixture of 9.1 g calcium oxide, 195 g (0.32 moles) Kortacid T-1402, purchased from Akzona, Inc., made from a $C_{14}$ olefin and acetic anhydride, 122 g water and 249.3 g toluene, were refluxed for two hours. Iron (II) sulfate heptahydrate (45.2 g, 0.16 moles) was added and held at reflux for two hours. The water was then removed by azeotropic distillation, the insoluble calcium and unreacted iron sulfates were removed by filtration and the toluene by distillation.

EXAMPLE 12

A manganese salt in accordance with the invention was prepared in a manner similar to Example 1 from an equivalent amount of manganese (II) sulfate monohydrate.

Excess metal sulfate may be used to insure removal of remaining trace amounts of calcium if desired. Mixed salts may be prepared in situ and mixtures of acids may be used if desired.

EVALUATION

A number of reaction products were prepared according to the disclosure herein. These materials were prepared by reacting the reactants shown in the Table in their equivalent chemical proportions. The additives and base fuel were blended at the levels indicated. Additives designated Example 1 and Example 2 were commercial materials derived from $C_{14}$ olefins. The first two numbers of the Kortacids indicate the number of carbon atoms in the olefin used (T1401 from $C_{14}$). Example 13 is a comparative commercial low temperature non-telomer fuel additive product known as Chevron 402 M.

CFPP, Cold Filter Plugging Point (IP 309/76: Institute of Petroleum Test 309/76). LTFT, Low Temperature Flow Test for Diesel Fuels, a filtration test under consideration by CRC (Coordination Research Council). LTFT Procedure: The test sample (200 ml) is gradually lowered to the desired testing temperature at a controlled cooling rate. After reaching that temperature the sample is removed from its cold box and filtered under vacuum through a 17 micrometer screen. If the entire sample can be filtered in less than 60 seconds it shall be considered as having passed the test. An F in this test indicates failure at the maximum acceptable temperature (−6° F.). Cloud Point and Pour Point were determined respectively by the D-250 and D-97 ASTM tests. All test results are shown in the Table.

Any suitable distillate fuel oil or diesel fuel oil may be used in accordance herewith. However, as mentioned hereinabove, fuels having an initial boiling point of about 350° F. and an end point of about 675° F. are preferred. The base diesel fuel used in these tests was a blend of 15% kerosene with 85% of a straight distillate having the following characteristics:

TABLE

| | |
|---|---|
| Initial b.p. | 366° F. |
| End Point | 663° F. |
| Viscosity, 40° C. | 2.185 cst |
| Conradson Carbon Residue | 0.04% |
| API Gravity | 34.8 |

| | Metal | (Kortacid) Acid | Wt. % | °F. CFPP | °F. LTFT | Cloud Point | Pour Point |
|---|---|---|---|---|---|---|---|
| Base Fuel | — | — | 100 | −3 | 1 | 11 | −10 |
| Example 1 comparative commercial additive | Ca | | 2.5 | −4 | F | 14 | −10 |
| Example 2 comparative commercial additive | Mg | | 1 | −12 | −11 | 5 | −50 |
| Example 3 | Mg | T1001 | 2.5 | −6 | | 5 | −20 |
| Example 4 | Mg | T1402 | 1 | −15 | −9 | −8 | −35 |
| Example 5 | Mg | T1802 | 1 | −16 | −8 | 10 | −45 |
| Example 6 | Mg | W2201 | 2.5 | −10 | | | −10 |
| Example 7 | Mg | W2601 | 2.5 | | Insoluble | | |

TABLE-continued

| | | | | | | | |
|---|---|---|---|---|---|---|---|
| Initial b.p. | | | | 366° F. | | | |
| End Point | | | | 663° F. | | | |
| Viscosity, 40° C. | | | | 2.185 cst | | | |
| Conradson Carbon Residue | | | | 0.04% | | | |
| API Gravity | | | | 34.8 | | | |
| | Metal | (Kort-acid) Acid | Wt. % | °F. CFPP | °F. LTFT | Cloud Point | Pour Point |
| Example 8 | Li | T1402 | 1 | −12 | −8 | 4 | −35 |
| Example 9 | Fe | T1402 | 1 | −12 | −8 | 10 | −65 |
| Example 10 | Fe | T1801 | .05 | −8 | −6 | 10 | −15 |
| Example 11 | Mn | T1801 | .05 | −6 | −6 | 12 | −15 |
| Example 12 | Mn | T1402 | 1 | −19 | −9 | −7 | −65 |
| Example 13 comparative commercial additive | | | .075 | −6 | F | 15 | −40 |

The data of the Table clearly show the improved results obtained when additive compositions in accordance with the invention are used. Examples 3–5 and 9–12 are in accordance with the invention. The important data is that with respect to the Cold Filter Plugging Point and the Low Temperature Flow Test. It is noted that two of the commercial additives failed the LTFT test.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A composition consisting essentially of a major proportion of a liquid hydrocarbon fuel and a minor proportion sufficient to improve filterability, cloud point and pour point of said composition of a salt selected from the group consisting of Mg, Mn, Fe and Co metal salts of a branched chain carboxylic acid or mixtures thereof, and wherein said carboxylic acid is a telomer acid at least a portion of which has the following generalized structural formula:

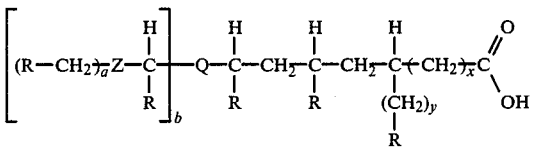

wherein
a is 0 or 1, and
if a is 0, Z is H, and
if a is 1, Z is a $CH_2$—group;
wherein
b is 0 or 1, and
if b is 0, Q is H and
if b is 1, Q is a $CH_2$—group, and
wherein
x is 0 or 2, and
if x is 0, y is 2 and
if x is 2, y is 0; and
R is $CH_3(CH_2)_n$, where n is an integer of from about 3 to about 42.

2. The composition of claim 1 wherein said fuel is a diesel fuel.

3. The composition of claim 2 wherein said fuel is a distillate fuel having an initial boiling point of about 350° F. and an end point of about 675° F.

4. The composition of claim 1 wherein the telomer acid has side chains of from about 8 to about 18 carbon atoms.

5. The composition of claim 4 wherein said telomer acid has a side chain of about 12 to about 16 carbon atoms.

6. The composition of claim 5 wherein the telomer acid has a side chain of about 12 carbon atoms.

7. The composition of claim 5 wherein the telomer acid has a side chain about 16 carbon atoms.

8. The composition of claim 6 wherein the metal is Mg.

9. The composition of claim 6 wherein the metal is Mn.

10. The composition of claim 6 wherein the metal is Fe.

11. The composition of claim 7 wherein the metal is Mg.

12. The composition of claim 7 wherein the metal is Mn.

13. The composition of claim 7 wherein the metal is Fe.

14. The composition of claim 1 wherein the metal telomer acid salt is present in an amount from about 0.01 to about 10 weight percent based on the weight of the total composition.

15. The composition of claim 14 wherein the metal telomer acid salt is present in an amount from about 0.05 to about 5 weight percent.

16. A method of improving the low temperature characteristics of a liquid hydrocarbon fuel comprising adding to said fuel a minor effective amount sufficient to improve filterability of a salt selected from the group consisting of Mn, Fe, Co and, Mg metal salts of a branched chain carboxylic acid or mixtures thereof and wherein said carboxylic acid is a telomer acid at least a portion of which has the following generalized structural formula:

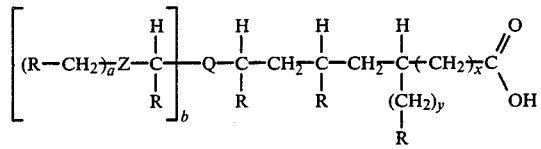

wherein
a is 0 or 1, and
if a is 0, Z is H, and
if a is 1, Z is a $CH_2$—group;
wherein
b is 0 or 1, and
if b is 0, Q is H and
if b is 1, Q is a $CH_2$—group, and
wherein
x is 0 or 2, and
if x is 0, y is 2 and
if x is 2, y is 0; and
R is $CH_3(CH_2)_n$, where n is an integer of from about 3 to about 42.

17. The method of claim 16 wherein said fuel is a diesel fuel.

18. The method of claim 17 wherein said fuel is a distillate fuel having an initial boiling point of about 350° F. and an end point of 675° F.

19. The method of claim 16 wherein said telomer acid has a side chain of about 8 to about 18 carbon atoms.

20. The method of claim 16 wherein said telomer acid has a side chain of from about 12 to about 16 carbon atoms.

21. The method of claim 16 wherein said metal is Mg.

22. The method of claim 16 wherein said metal is Fe.

23. The method of claim 16 wherein said metal is Mn.

24. A process of preparing a metal salt of a branched chain carboxlic acid comprising reacting (1) a metal oxide, a metal salt or a metal hydroxide and a branched chain carboxylic acid in at least equivalent amounts in the presence of a water/immiscible organic solvent system and reacting (2) the intermediate product thereof with at least equivalent amounts of a metal sulfate selected from the group consisting of Mn, Fe, Co, and Mg sulfates and wherein the carboxylic acid is a telomer acid at least a portion of which has the following generalized structural formula:

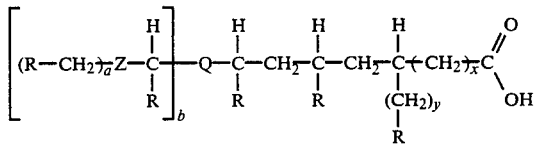

wherein a is 0 or 1, and if a is 0, Z is H, and if a is 1, Z is a $CH_2$—group;

wherein b is 0 or 1, and if b is 0, Q is H and if b is 1, Q is a $CH_2$—group, and wherein x is 0 or 2, and if x is 0, y is 2 and if x is 2, y is 0; and R is $CH_3(CH_2)_n$, where n is an integer of from about 3 to about 42.

25. The process of claim 24 wherein the reaction is conducted at a temperature between about 70° and about 300° F.

26. The process of claim 24 wherein the organic solvent is toluene.

27. An additive product prepared by reacting a branched chain carboxylic acid wherein said carboxylic acid is a telomer acid at least a portion of which has the following generalized formula:

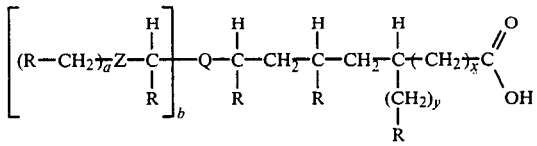

wherein a is 0 or 1, and if a is 0, Z is H, and if a is 1, Z is a $CH_2$—group;

wherein b is 0 or 1, and if b is 0, Q is H and if b is 1, Q is a $CH_2$—group, and wherein x is 0 or 2, and if x is 0, y is 2 and if x is 2, y is 0; and R is $CH_3(CH_2)_n$, where n is an integer of from about 3 to about 42;

having a side chain of from about 8 to about 18 carbon atoms comprising reacting in at least equivalent amounts a metal oxide, a metal salt or a metal hydroxide with said carboxylic acid in the presence of a water/immiscible organic solvent system with a metal sulfate selected from the group consisting of Mn, Fe, Co, and Mg sulfates in at least equivalent amounts.

28. The product of claim 27 wherein the reaction is conducted at a temperature between about 70° and about 300° F.

29. The product of claim 27 wherein the organic solvent is toluene.

* * * * *